US007077294B2

(12) United States Patent
Nusbaum et al.

(10) Patent No.: US 7,077,294 B2
(45) Date of Patent: Jul. 18, 2006

(54) DEVICE FOR STOPPERING A CONTAINER AND DRAWING OFF A FLUID PRODUCT

(75) Inventors: Philippe Nusbaum, Daix (FR); Frédéric Granier, Brognon (FR); Antonio Jubany Claret, Granollers (ES); Oriol Aran Garcia, Barcelonne (ES)

(73) Assignee: BERICAP, Longvic (FR)

( * ) Notice: Subject to any disclaimer, the term of this patent is extended or adjusted under 35 U.S.C. 154(b) by 12 days.

(21) Appl. No.: 10/487,483

(22) PCT Filed: Jul. 24, 2002

(86) PCT No.: PCT/FR02/02655

§ 371 (c)(1),
(2), (4) Date: Dec. 15, 2004

(87) PCT Pub. No.: WO03/011702

PCT Pub. Date: Feb. 13, 2003

(65) Prior Publication Data

US 2005/0127102 A1 Jun. 16, 2005

(30) Foreign Application Priority Data

Jul. 31, 2001 (FR) ..... 01 10268

(51) Int. Cl.
*B67B 5/00* (2006.01)

(52) U.S. Cl. ..... 222/153.06; 222/153.07; 222/482; 222/519; 222/541.6; 222/566; 220/253; 220/367.1

(58) Field of Classification Search ..... 222/153.06, 222/519, 153.05, 153.14, 153.04, 153.07, 222/523, 566, 541.6, 541.5, 481.5, 567–568, 222/521, 482–485, 541.9, 544–548; 220/253, 220/367.1, 255.1
See application file for complete search history.

(56) References Cited

U.S. PATENT DOCUMENTS

| | | | | |
|---|---|---|---|---|
| 3,892,326 | A * | 7/1975 | Schneible | 215/221 |
| 4,007,857 | A * | 2/1977 | Tomiati et al. | 222/153.14 |
| 4,619,377 | A * | 10/1986 | Roos | 222/83 |
| 5,662,247 | A * | 9/1997 | Rapchak et al. | 222/153.07 |
| 5,785,213 | A * | 7/1998 | Guillot | 222/553 |
| 5,839,611 | A * | 11/1998 | Obadia et al. | 222/153.14 |
| 6,382,462 | B1 * | 5/2002 | Ostergaard-Nielsen et al. | 222/1 |
| 6,401,982 | B1 * | 6/2002 | Grittmann | 222/153.05 |
| 6,450,367 | B1 * | 9/2002 | Sittler | 222/39 |
| 6,793,101 | B1 * | 9/2004 | Shinozaki et al. | 222/153.02 |

* cited by examiner

*Primary Examiner*—Frederick C. Nicolas
(74) *Attorney, Agent, or Firm*—Myron Greenspan, Esq.; Lackenbach Siegel, LLP

(57) ABSTRACT

A device for stoppering a container and drawing off a fluid includes a fixed piece, fixed to the container, with a lateral fluid output opening and a passage that allows air to enter. Another, movable piece includes a tube with a lateral fluid output opening. This tube can move in rotation inside the fixed piece and also in axial translation between a maximum "pushed-in" position and an extracted position so that lateral openings can be brought into coincidence through rotating the movable piece. The movable piece has an internal skirt enabling the channeling of fluid toward the output opening to prevent leakage through the passage for the entry of air. The fixed piece includes a guide for displacing the movable piece with respect to the fixed piece from the maximum "pushed-in" position to the extracted position that displays a coincidence of the openings.

19 Claims, 9 Drawing Sheets

DEVICE FOR STOPPERING A CONTAINER AND DRAWING OFF A FLUID PRODUCT

BACKGROUND OF THE INVENTION

Field of the Invention

The invention concerns a device for stoppering a container and drawing off a fluid product contained in said container.

Such devices are already known, in particular according to the patent EP 0 815 030 originating from the Applicant.

DESCRIPTION OF THE PRIOR ART

Devices are already known, in particular according to European Patent No. 0 815 030, which originated from the applicant, that include:

a fixed piece comprising a part for fixing to the container and a pouring part of general cylindrical shape, continuing said fixing part towards the outside of the container, the pouring part being open at its two axial ends and having a lateral fluid output opening and means defining a passage allowing the entry of air into the device during pouring of the fluid;

a movable piece comprising a transverse end wall from which there project in the same direction on the one hand a tube of general cylindrical shape, open at its free axial end and having at least one lateral fluid output opening, and on the other hand an external skirt making it possible to grip and operate the movable piece from the outside.

The tube is mounted with a tight fit in the pouring part of the fixed piece so that the movable piece is:

movable rotationally in the fixed piece;

and movable in axial translation with respect to the fixed piece.

To that end, the fixed piece and the movable piece comprise first means designed for defining a first axial position of the movable piece with respect to the fixed piece, referred to as the maximum pushing-in position, in which the lateral openings in the two pieces are offset axially so that it is not possible for them to be brought into coincidence. These first means comprise for example a tamper-resistant band which, as long as it is not torn off, connects the external skirt to the fixed piece.

The fixed piece and the movable piece also comprise second means designed for defining a second axial position of the movable piece with respect to the fixed piece, referred to as the extraction position, in which the lateral openings in the two pieces can be brought into coincidence by rotation of the movable piece. These second means comprise for example flanges latching with one another.

Such devices generally give satisfaction. However, they have a number of drawbacks.

When the movable piece is in the extraction position, with coincidence of the lateral openings in the two pieces (fixed and movable), the container is tilted in order to pour out the fluid contained in this container, the fluid output opening in the fixed piece thus being situated towards the bottom.

There is then a risk of leakage of fluid through the passage allowing the entry of air, in particular when the container is full, or when the user exerts pressure on the container.

Furthermore, the rotation of the movable piece with respect to the fixed piece is totally free, both when the movable piece is in the maximum pushing-in position and when it is in the extraction position.

This, on the one hand, can lead to wear of the latching flanges by friction between the pieces when the movable piece is in the maximum pushing-in position. In that way, the keeping of the movable piece in the extraction position risks being impaired.

On the other hand, when the movable piece is in the extraction position, the free rotation of this piece does not allow easy positioning of the openings in the two pieces with respect to one another, thus preventing accurate adjustment of the flow rate of the fluid poured out.

SUMMARY OF THE INVENTION

The aim of the invention is to solve these problems.

To that end, the invention concerns a stoppering and drawing-off device of the aforementioned type, in which the movable piece also comprises an internal skirt projecting from the transverse wall in the same direction as the tube, between said tube and the external skirt, said internal skirt having an axial length such that, when the movable piece is in the extraction position, the free end of the internal skirt is situated facing the pouring part of the fixed piece.

In that way, during pouring of the fluid, the fluid contained in the container cannot escape through the passage allowing the entry of air but is channelled, in the annular space contained between the tube and the internal skirt, towards the fluid output opening in the fixed piece.

The pouring part comprises for example a prominence projecting towards the outside, substantially diametrically opposite the fluid output opening, said prominence defining a passage allowing the entry of air into the device, when the movable piece is in the extraction position and during pouring of the fluid.

According to other characteristics, the fixed piece comprises:

third means intended to cooperate with complementary means provided on the movable piece, so as to limit to a reduced value the amplitude of the rotational movement of the movable piece with respect to the fixed piece in the two directions when the movable piece is in the maximum pushing-in position, and to permit the axial displacement of said movable piece towards the extraction position;

fourth means intended to cooperate with complementary means provided on the movable piece, so as to allow the movable piece to be kept in the extraction position and to limit the amplitude of the rotational movement of the movable piece with respect to the fixed piece between a position where the lateral openings in the two pieces coincide perfectly and a position where no area of the opening in the movable piece is in coincidence with an area of the opening in the fixed piece.

The invention thus makes it possible to limit the rotation of the movable piece with respect to the fixed piece, and also to guide and facilitate the displacement of the movable piece with respect to the fixed piece from the maximum pushing-in position to the extraction position with coincidence of the openings.

The user is thus guided so as to displace the movable piece along the shortest path. The regulation of the flow rate is facilitated and improved thereby.

According to the invention, the internal skirt comprises at least one rib projecting towards the axis of the tube, and the fixed piece comprises at least one limit stop projecting towards the outside of the pouring part of the fixed piece, the rib being intended to cooperate with the limit stop so as to limit the amplitude of the rotational movement of the movable piece with respect to the fixed piece in a first direction, when the movable piece is in the maximum pushing-in position or in the extraction position.

According to one possible implementation, the tube comprises two diametrically opposite fluid output openings, and the internal skirt comprises at least one rib situated at substantially 90° from each opening.

The limit stop projecting from the pouring part can be situated towards the free end of said pouring part, the axial height of said limit stop being small compared with the axial height of the pouring part. For example, the limit stop is substantially diametrically opposite the lateral fluid output opening.

Furthermore, the pouring part can comprise a ramp which is substantially flat and orthogonal to the axis of the pouring part, projecting towards the outside of the pouring part and extending over part of the periphery of the pouring part, said ramp being situated towards the free end of said pouring part, but at a distance therefrom, and being intended to prevent the movable piece from being displaced from its extraction position towards its maximum pushing-in position.

The distance between the free end of the pouring part and the ramp can be substantially equal to the axial height of the limit stop projecting from the pouring part.

According to other characteristics, a first end of the ramp is situated in proximity to, but at a distance from, the limit stop projecting from the pouring part, in a second direction opposite to the first direction, so as to limit the amplitude of the rotational movement of the movable piece with respect to the fixed piece in said second direction, when the movable piece is in the maximum pushing-in position.

The ramp extends from its first end in the second direction to a second end, said second end of the ramp being continued by a wall substantially parallel to the axis of the pouring part and directed towards the free end of the pouring part, said wall being intended to cooperate with a rib of the movable piece so as to limit the amplitude of the rotational movement of the movable piece with respect to the fixed piece in the second direction, when the movable piece is in the extraction position.

Thus, when the movable piece is in the maximum pushing-in position, the rib is placed between the limit stop projecting from the pouring part of the fixed piece and the first end of the ramp; when the movable piece is in the extraction position, the rib is situated between the limit stop projecting from the pouring part of the fixed piece—a position in which the rib is not in contact with the ramp and where no area of the opening in the movable piece is in coincidence with an area of the opening in the fixed piece—and the wall continuing the second end of the ramp—a position in which the rib is in contact with the ramp and where the lateral openings in the two pieces coincide.

Moreover, the fixed piece can comprise at least one internal flange defining a groove in which a flange projecting towards the outside of the tube of the movable piece is able to be engaged, so as to keep the movable piece axially in its extraction position corresponding to the second position.

The internal flange extends for example over two diametrically opposite arcs each extending over approximately 90°.

Furthermore, the first means comprise a tamper-resistant band which, as long as it is not torn off, connects the external skirt to the fixed piece and keeps the movable piece in an axial maximum pushing-in position, corresponding to said first axial position, and in a defined angular position, and in that, after tearing off of said tamper-resistant band and translational movement of the movable piece with respect to the fixed piece towards said second axial position, the second means permit a rotation of the movable piece with respect to the fixed piece in order to make it possible to bring the lateral openings in the two pieces selectively into coincidence with a view to the dispensing of the product.

According to one possible implementation, the fixed piece is fixed by screws to the neck of the container, and in that the fixed piece comprises, on its fixing part, a tamper-resistant ring cooperating by latching with the neck.

BRIEF DESCRIPTION OF THE DRAWINGS

The other characteristics of the invention emerge from the following description of one embodiment, said description being given with reference to the accompanying figures in which.

DETAILED DESCRIPTION OF THE PREFERRED EMBODIMENTS

Figure 1:
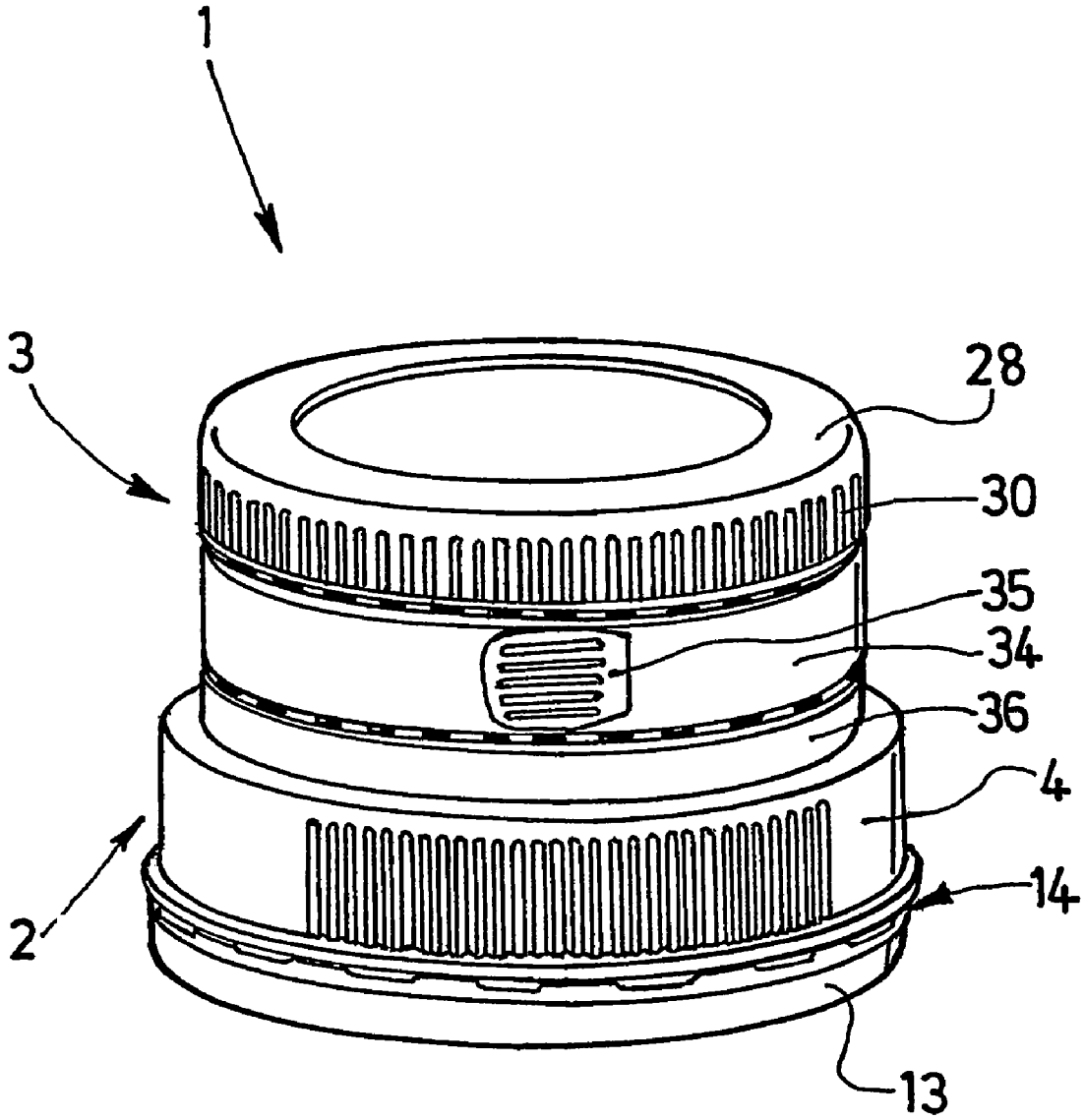
FIG. 1 is a perspective view of the device according to the invention.
Figure 2:
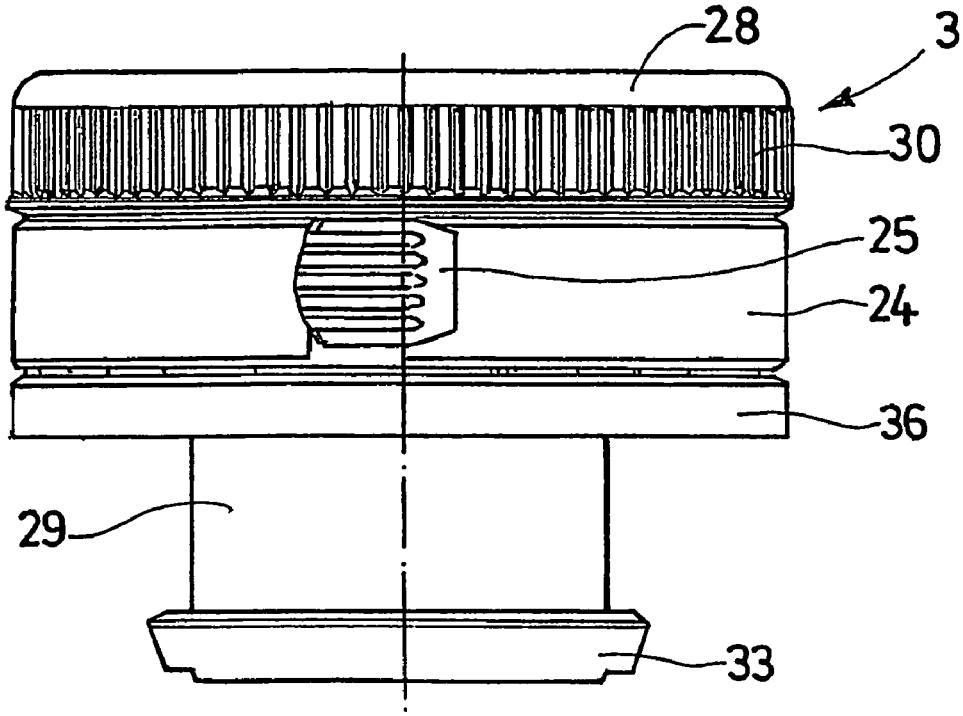
FIG. 2 is a view in side elevation of the movable piece of the device.

A dispenser 1 in accordance with the invention is intended for stoppering a container such as a plastic bottle (not depicted) and drawing off a fluid product contained in said container.

The dispenser 1 comprises a fixed piece 2 intended to be fixed to the neck of the container and a movable piece 3 cooperating with the fixed piece 2, intended for controlling and adjusting the drawing off of the fluid contained in the container.

In the entire description, the terms "upper" and "lower" are used for simplification purposes, considering that the axis of the device is substantially vertical, the fixed piece 2 being situated above the movable piece 3. It should be understood however that the device can be situated in any position whatsoever in space.

The fixed piece 2 comprises a part 4 for fixing to the container and a pouring part 5 of general cylindrical shape, continuing said fixing part 4 towards the outside of the container.

The fixing part 4 comprises an external skirt 6 provided with an internal thread 7, and an internal skirt 8 intended to cooperate with the internal surface of the neck in order to provide sealing between the fixed piece 2 and the neck.

The external skirt 6 has, at a distance above the thread 7, a discontinuity in alignment towards the inside, forming an annular shoulder 9 joining the internal skirt 8 substantially at half its axial height.

The lower part of the internal skirt 8 has a first annular flange 10, facing the external skirt 6, said first flange 10 being intended to be in contact with the internal surface of the neck.

The upper part of the internal skirt 8 has, towards its end part, a second annular flange 11, projecting towards the outside, and whose function will be explained later.

The upper end part of the internal skirt 8 is connected to the pouring part 5 of the fixed piece 2 by an annular shoulder 12 extending towards the inside of said fixed piece 2.

Finally, the fixing part 4 comprises a tamper-resistant band 13 connected by breakable bridges 14 or a line of lower resistance to the free end of the external skirt 6. The tamper-resistant band 13 comprises hooking projections 15, directed towards the axis of the fixed piece 2, intended to cooperate with the neck of the container.

The fixing part 4 is continued, towards the internal edge of the annular shoulder 12, by the pouring part 5, which extends axially upwards in the figures, that is to say towards the outside of the container.

The pouring part 5 comprises first of all a cylindrical skirt 16 of small axial length, comprising at its lower free end two circular rows of internal flanges 17 forming a groove 18.

Figure 4:
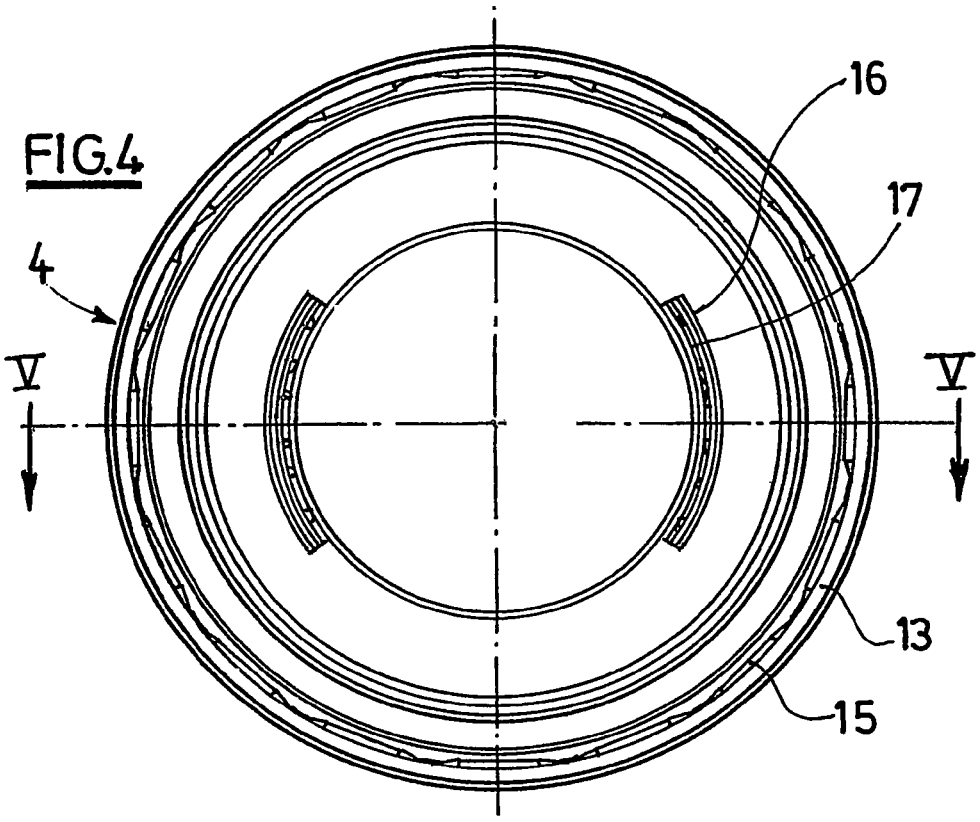
FIG. 4 is a bottom view of the fixed piece.
Figure 5:
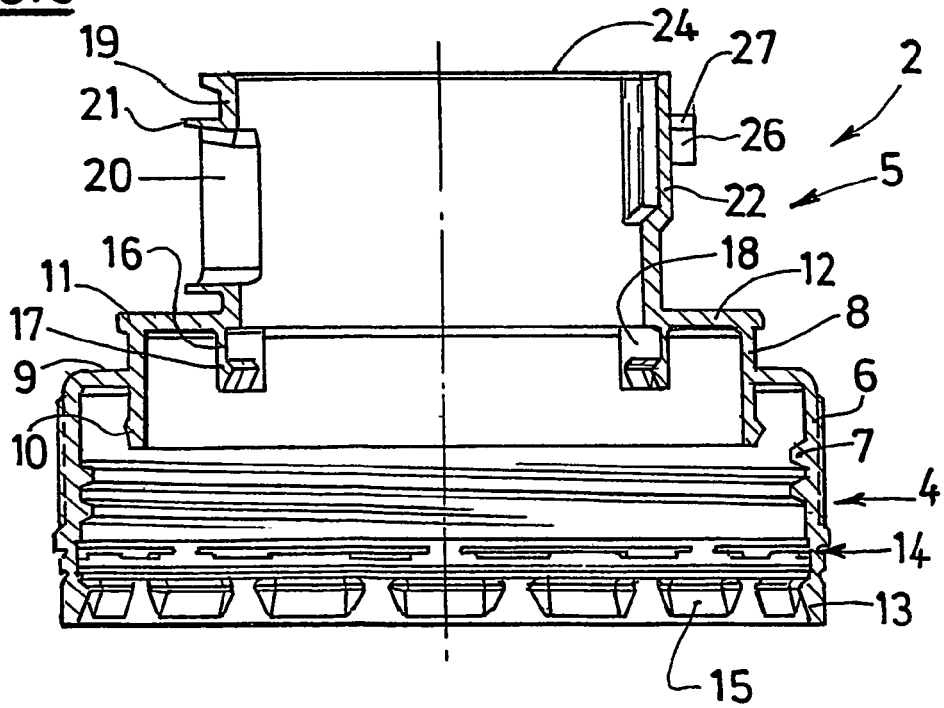
FIG. 5 is a view in axial section of the fixed piece of the device along the line V—V of FIG. 3.
Figure 6:
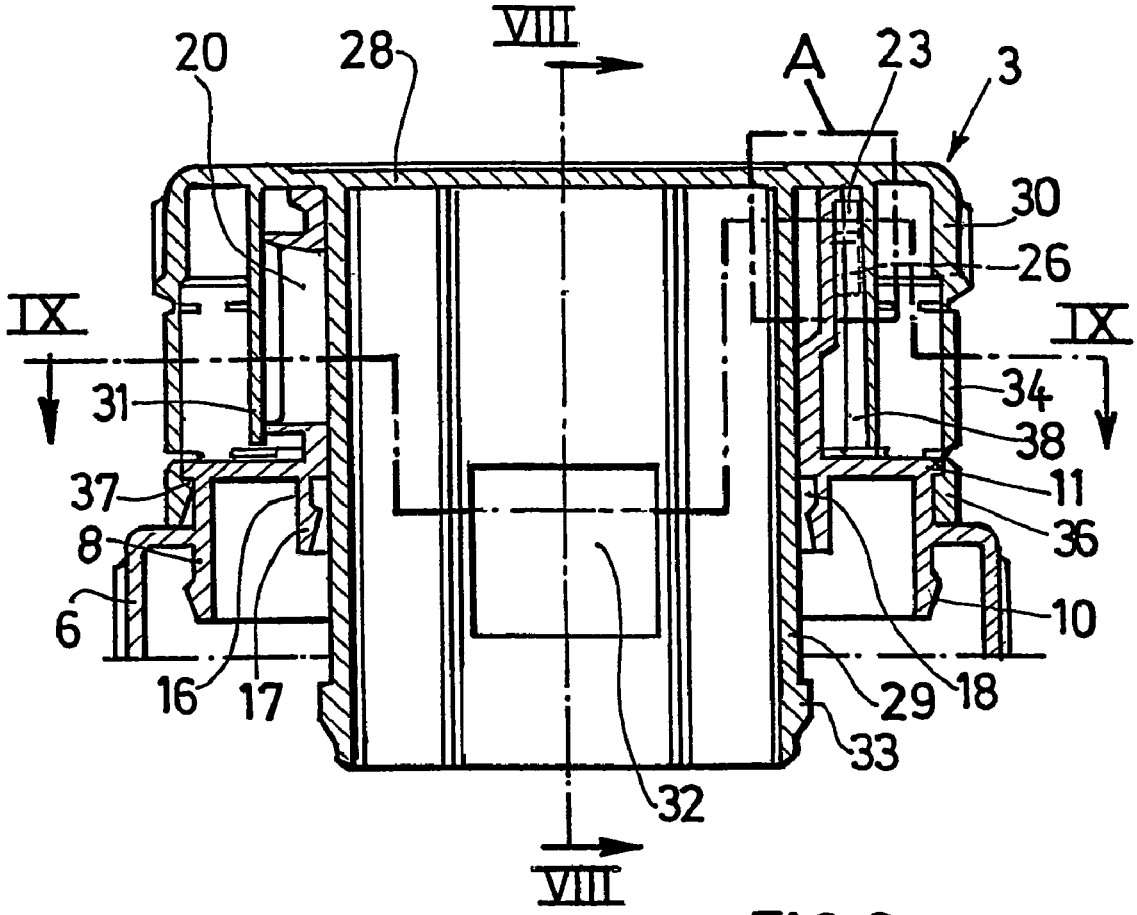
FIG. 6 is a view in axial section of the device when the tamper-resistant band has not yet been torn off.
Figure 7:
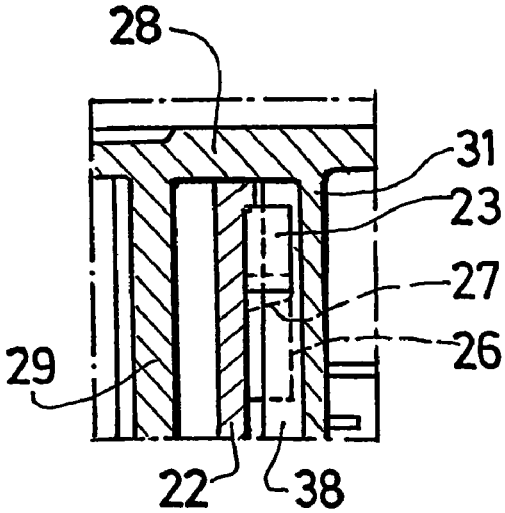
FIG. 7 is an enlarged view of the detail A of FIG. 6.
Figure 8:
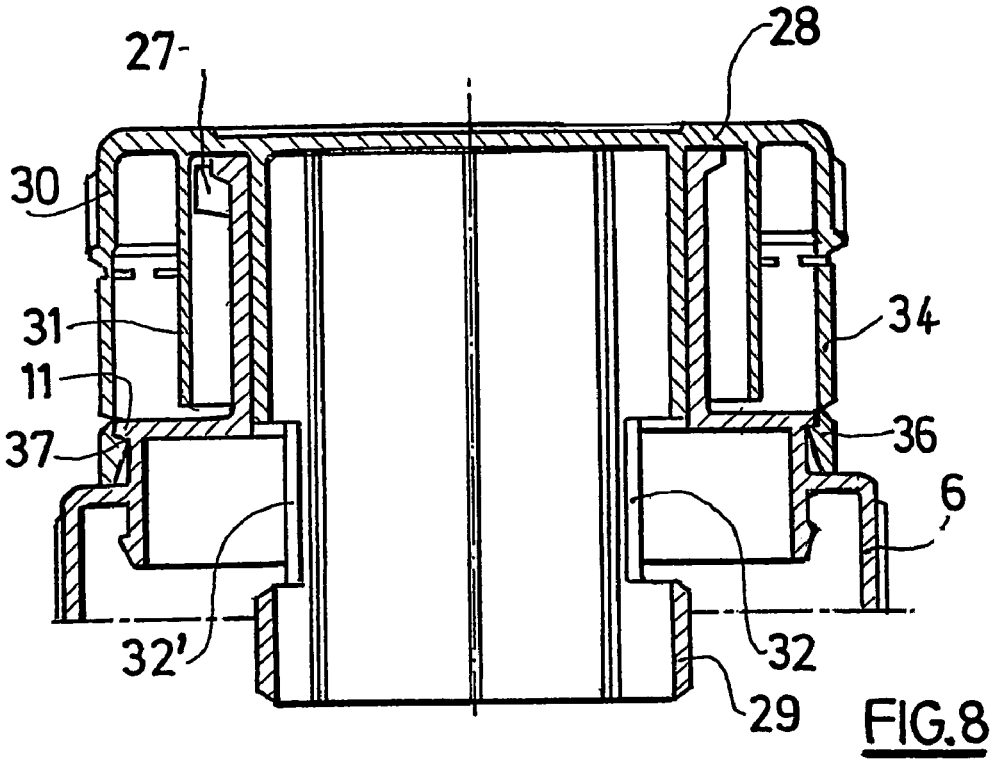
FIG. 8 is a sectional view of the device, when the tamper-resistant band has not yet been torn off, along the line VIII—VIII of FIG. 6.
Figure 9:
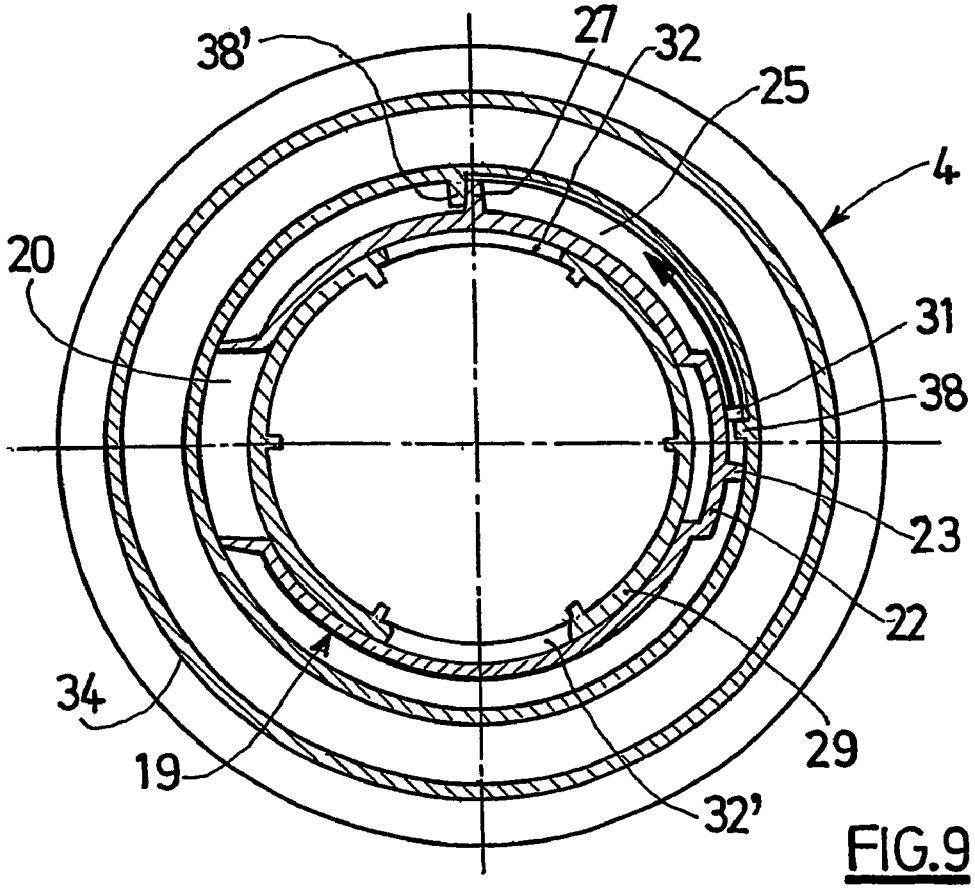
FIG. 9 is a sectional view of the device, when the tamper-resistant band has not yet been torn off, along the line IX—IX of FIG. 6.

Each of the rows of flanges 17 extends over substantially 90° of angle, said two rows being substantially diametrically opposite, as depicted in FIG. 4.

The pouring part 5 also comprises a cylindrical part 19 which comprises a lateral fluid output opening 20, said opening 20 being situated at a distance above the annular shoulder 12 and being provided with a rim 21 extending radially towards the outside and forming a pouring lip. In the implementation depicted, the opening 20 is situated substantially half-way along the cylindrical part 19, in line with a row of internal flanges 17.

The pouring part 5 also comprises a prominence 22 projecting towards the outside of the cylindrical part 19, said prominence being substantially diametrically opposite the fluid output opening 20, and defining a passage allowing the entry of air into the device 1 during pouring of the fluid.

Finally, the pouring part 5 comprises means making it possible to limit the displacement of the movable piece 3 with respect to said fixed piece 2.

On the one hand, the pouring part 5 comprises a limit stop 23 projecting towards the outside of the cylindrical part 19, from the prominence 22, said limit stop 23 being substantially diametrically opposite the fluid output opening 20.

The substantially parallelepipedal limit stop 23 extends axially from the upper end 24 of the cylindrical part 19 over a small axial length compared with the height of said cylindrical part 19, for example over less than a quarter of this height.

On the other hand, the pouring part 5 comprises a ramp 25, which is substantially flat and orthogonal to the axis of the pouring part 5, projecting towards the outside of the pouring part 5. The ramp 25 extends over part of the periphery of the pouring part, for example over approximately 90° of angle.

The ramp 25 is situated towards the upper end 24 of the cylindrical part 19, at a distance therefrom, the distance between the upper end 24 and the ramp 25 being substantially equal to the axial height of the limit stop 23.

A first end of the ramp 25 is situated in proximity to, but at a distance from, the limit stop 23, and is continued by a first wall 26 extending axially towards the fixing part 4 over a small length.

A second end of the ramp 25, situated on one side of the first end of the ramp 25 not comprising the limit stop 23, is continued by a second wall 27 extending axially substantially as far as the upper end 24 of the cylindrical part 19.

A first direction of rotation R1 about the axis of the fixed piece 2, going from the first wall 26 towards the limit stop 23, and a second direction of rotation R2, opposite to the first direction of rotation R1, going from the limit stop 23 to the second wall 27, going past the first wall 26 (see FIG. 3), are defined.

The movable piece 3 is now described.

The movable piece 3 comprises a transverse end wall 28, from which there project in the same direction a tube 29 of general cylindrical shape, an external skirt 30 making it possible to grip and operate the movable piece from the outside, and an internal skirt 31, situated between the tube 29 and the external skirt 30.

The tube 29 is open at its free axial end and has two substantially diametrically opposite lateral fluid output openings 32, 32'.

The tube 29 comprises, towards its free axial end, a flange 33, projecting towards the outside of the tube 29, able to be engaged in the groove 18 of the fixed piece 2.

The tube 29 is mounted with a tight fit in the pouring part 5 of the fixed piece 2 so that the movable piece 3 is movable rotationally and translation-wise in the fixed piece 2.

The external skirt 30 is continued, towards its free end, by a tamper-resistant band 34 which can be torn off by pulling a tab 35, and by a ring 36 provided with an internal annular flange 37 capable of cooperating with the second annular flange 11 of the fixed piece 2.

Finally, the internal skirt 31 comprises a rib 38 projecting towards the axis of the tube 29 and extending axially over substantially the entire axial height of said internal skirt 31.

The rib 38 is situated at substantially 90° from each fluid output opening 32, 32' in the tube 29, and is intended to cooperate with the limit stop 23 of the pouring part 5 of the fixed piece 2.

The internal skirt can also comprise a second rib 38'.

A description is now given of the different positions that the movable piece 3 can take with respect to the fixed piece 2.

Before the device 1 placed on the neck of a container is opened for the first time, the movable piece 3 is situated in the position illustrated in FIGS. 6 to 9.

The ring 36, latched behind the second annular flange 11 of the fixed piece 2, connected to the tamper-resistant band 34, keeps the movable piece 3 fixed to the fixed piece 2.

The movable piece is then in its so-called maximum pushing-in position. In this position, the free end of the internal skirt 31 is situated in proximity to the annular shoulder 12 of the fixing part 4, and the tube 29 goes inside said fixing part 4. The openings 32, 32' in the tube 29 and the opening 20 in the cylindrical part 19 of the fixed piece 2 are offset axially, so that they cannot be brought into coincidence.

The rib 38 of the movable piece 3 is situated between the limit stop 23 of the pouring part 5 of the fixed piece 2 and the first wall 26 of the ramp 25.

Figure 10:
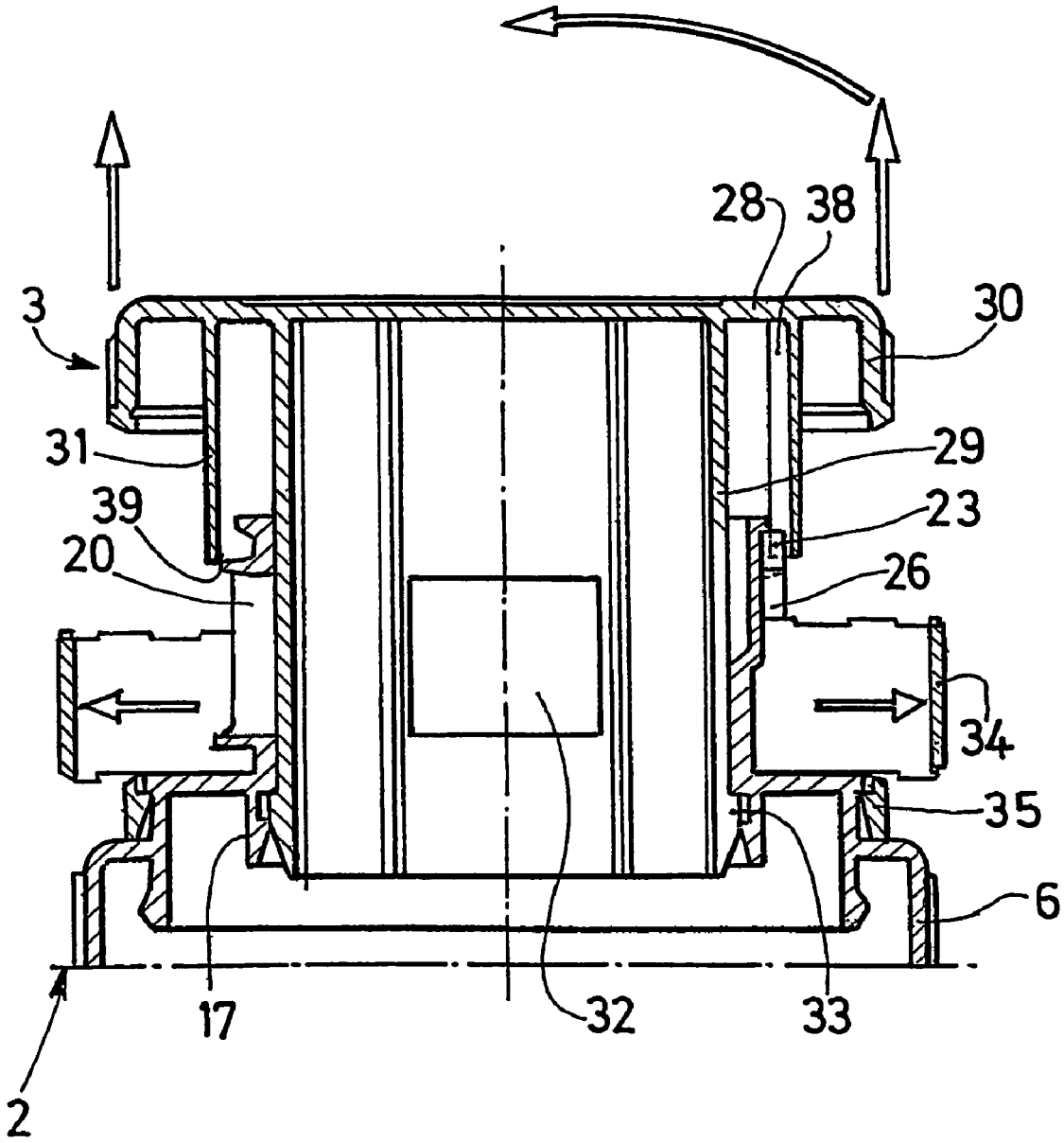
FIG. 10 is a sectional view, similar to that of FIG. 6, showing the tamper-resistant band torn off and the axial displacement, towards the extraction position, of the movable piece.

Upon first use, the tamper-resistant band 34 is pulled off, as illustrated in FIG. 10.

The movable piece 3 is then no longer fixed to the fixed piece 2, and can be displaced on the one hand rotationally, in the directions R1 and R2, and on the other hand in axial translation upwards.

When the movable piece 3 is in the maximum pushing-in position, the displacement of the movable piece 3 rotationally with respect to the fixed piece 2 is limited, in the two directions R1, R2, to a reduced value, by the limit stop 23 and the first wall 26 of the ramp 25, via the rib 38.

Figure 3:
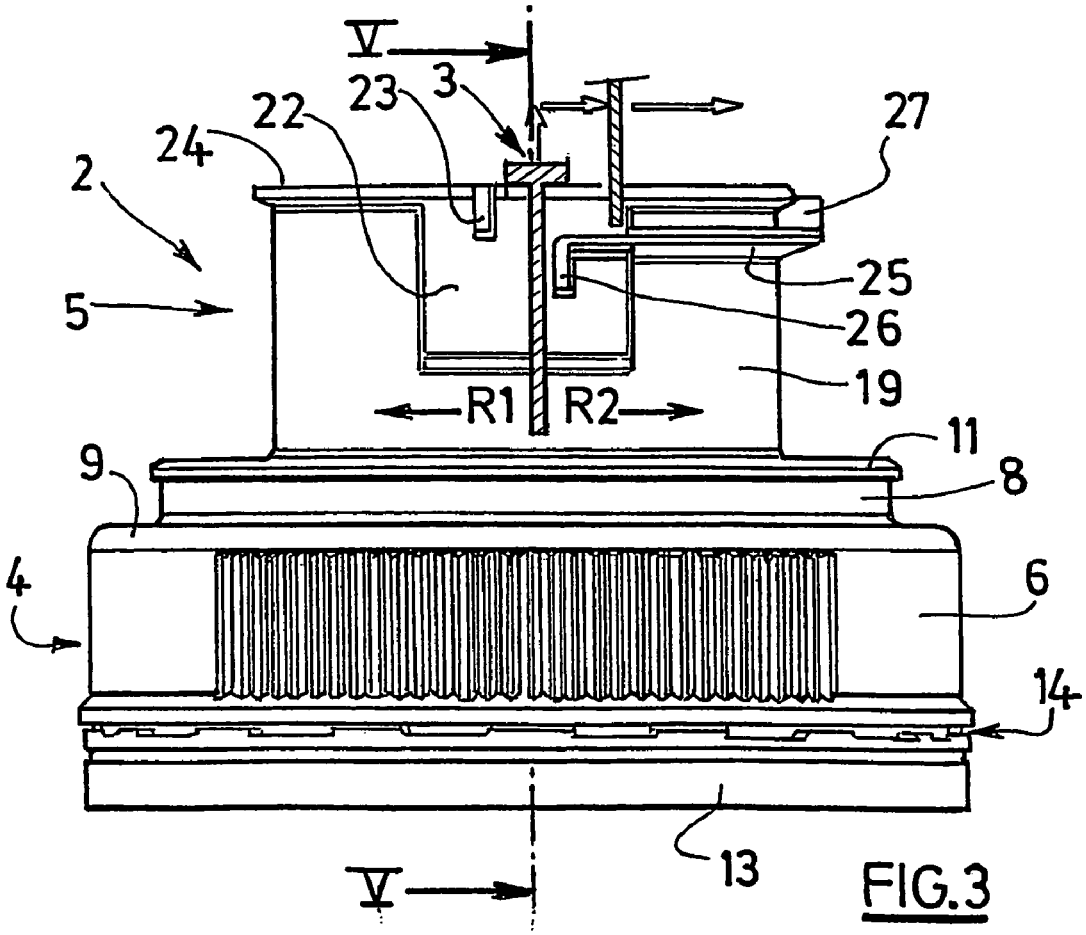
FIG. 3 is a view in side elevation of the fixed piece of the device, showing part of the movable piece.

As regards axial displacement, this is permitted, but guided, between the limit stop 23 and the first wall 26 of the ramp 25, as shown in FIG. 3.

In the extreme up position, referred to as the extraction position, the flanges 33 of the tube are engaged in the grooves 18 of the fixed piece 2, so as to allow the movable piece 3 to be kept in this extraction position.

The lateral openings 20, 32, 32' in the two pieces 2, 3 are situated substantially at the same axial distance. As the movable piece 3 is movable rotationally in the fixed piece 2, the openings 32, 32' in the movable piece 3 can therefore be brought into coincidence with the opening 20 in the fixed piece 2 by rotation of the movable piece 3.

In the extraction position, the movable piece 3 can be displaced rotationally between a position in which no area of the opening 32, 32' in the movable piece 3 is in coincidence with an area of the opening 20 in the fixed piece 2 and a position in which one of the openings 32, 32' in the movable piece 3 is in perfect coincidence with the opening 20 in the fixed piece 2.

Figure 11:
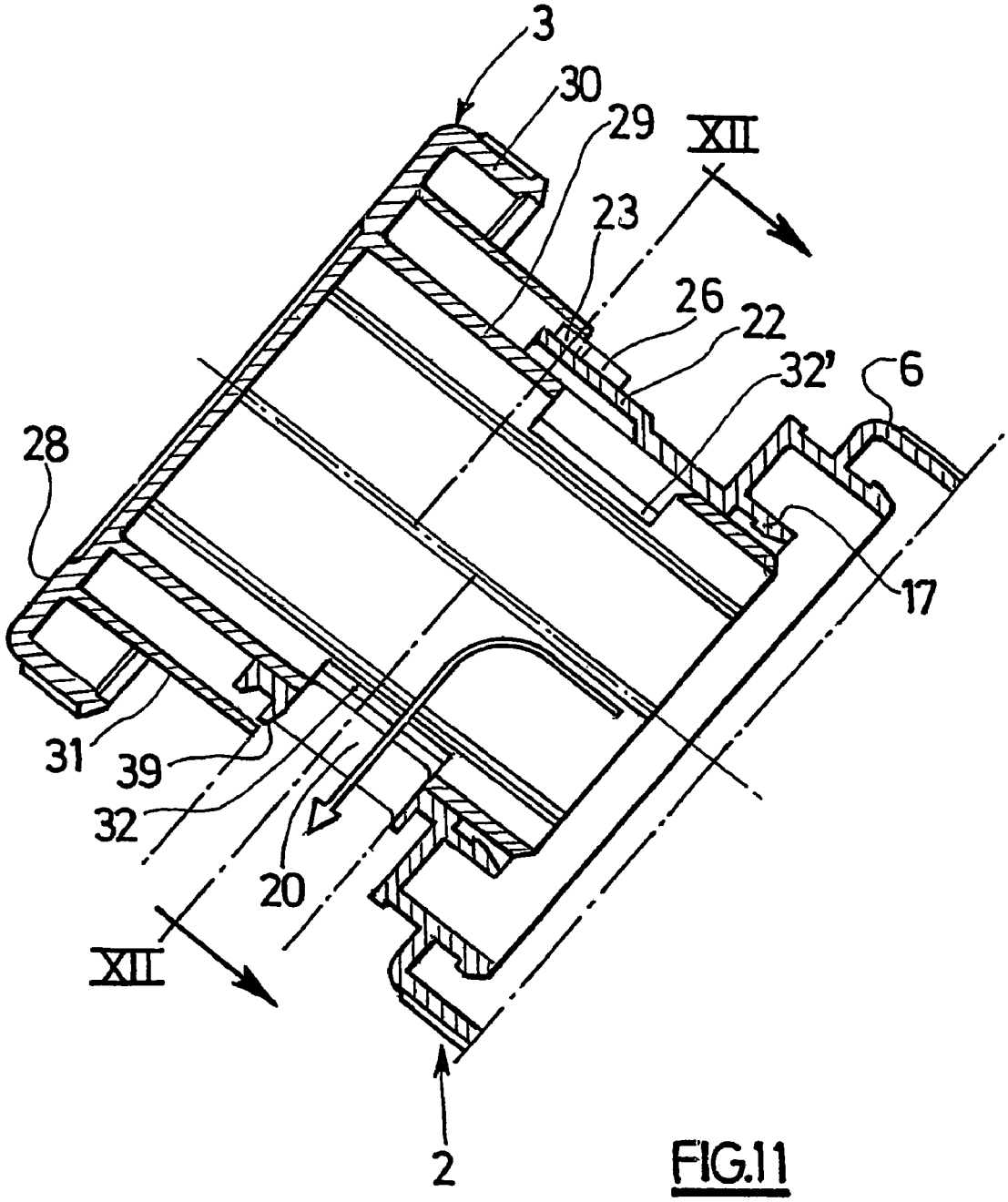
FIG. 11 is a sectional view, similar to that of FIG. 10, the movable piece having been turned by 90° about its axis and the device being tilted, so as to allow flowing of the fluid.
Figure 12:
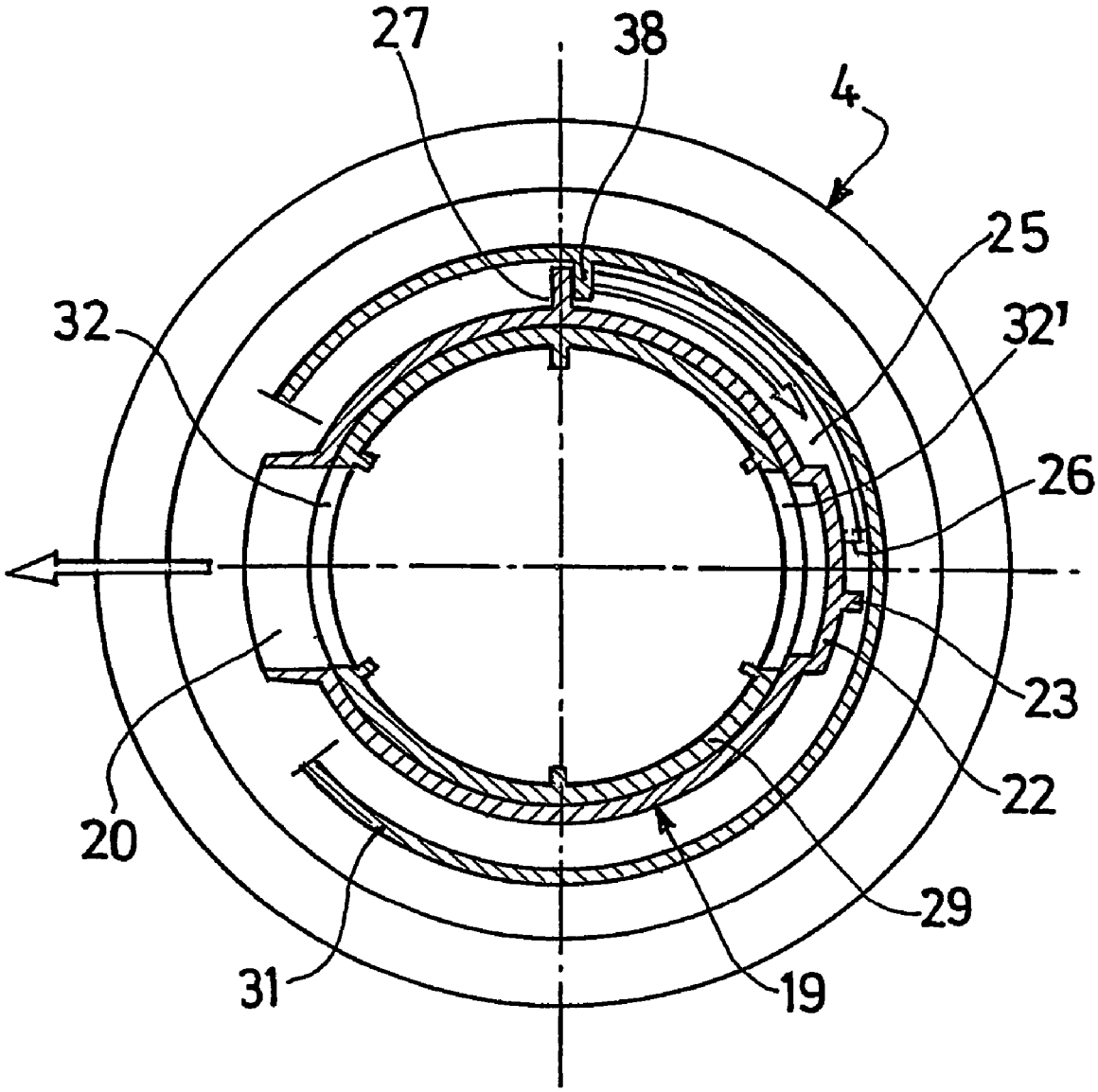
FIG. 12 is a sectional view of the device along the line XII—XII of FIG. 11.
Figure 13:
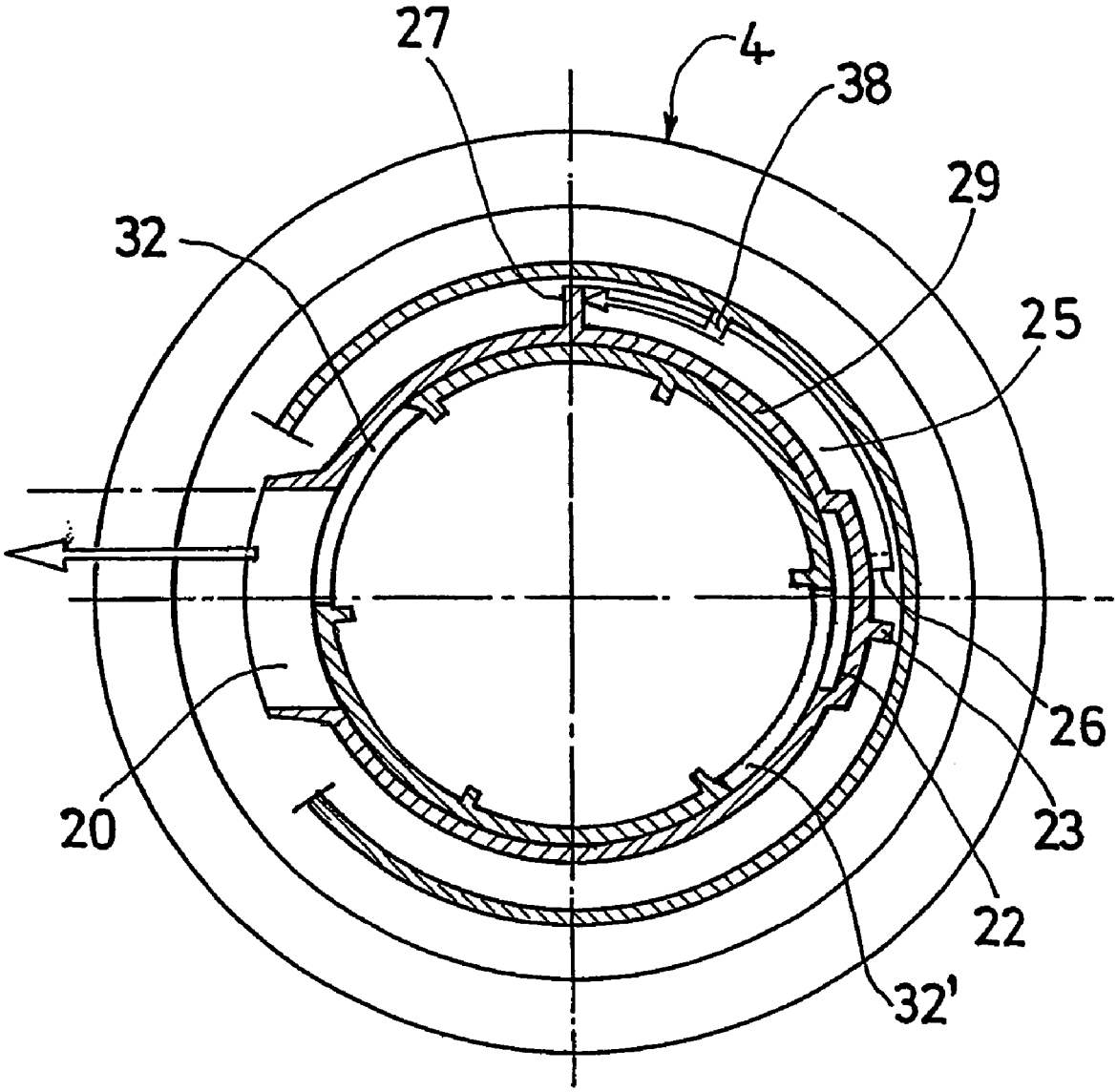
FIG. 13 is a view similar to that of FIG. 12, the movable piece being in an intermediate position with respect to the positions of FIGS. 10 and 11, which allows an intermediate flow rate.

In the aforementioned first position, no fluid flow is possible (FIG. 10), whilst, in the aforementioned second position, the flow rate of the fluid is a maximum (FIGS. 11 and 12). It should be noted that the ring 36 has not been depicted in FIG. 11. Intermediate positions are possible, which makes it possible to regulate the flow rate (FIG. 13). This regulation is all the easier since the ramp 25 serves as a bearing surface for the internal skirt 31, allowing the movable piece 3 to be kept in the extraction position, since, on account of their discontinuity, the flanges 17 of the fixing part 4 no longer perform this function.

The container is tilted in order that the liquid can be poured out (FIG. 11). A passage of air is possible owing to the presence of the prominence 22 of the cylindrical part of the fixed piece 2, which facilitates the flowing of the fluid out of the container.

The axial length of the internal skirt 31 is such that, when the movable piece 3 is in the extraction position, the free end of the internal skirt 31 is situated facing the pouring part 5 of the fixed piece 2 (see FIG. 11).

If there is pressure inside the container, for example when the container is full or if a user presses said container, the fluid contained in the container can flow out through the opening 32' in the tube 29 which is not in coincidence with the opening 20 in the fixed piece 2, and through the air passage formed at the prominence 22.

On account of the presence of the internal skirt 21, and its axial length, the fluid is channelled in the annular space contained between the tube 29 and the internal skirt 31. Under the effect of gravity (the device being tilted as depicted in FIG. 11), this fluid is directed towards the opening 20 in the fixed piece 2, and flows out from the aforementioned annular space towards the outside of the device, a gap 39 being provided for that purpose between the free end of the internal skirt 31 and the rim 21 of the opening 20.

The invention therefore makes it possible to recover the fluid leaking through the passage intended to allow the entry of air, and to direct it in proximity to the desired fluid flow opening. Thus, on the one hand, the device makes it possible to avoid an undesirable leakage, and on the other hand to lose a certain amount of fluid.

When the movable piece 3 is in the extraction position, the rib 38 is situated between the limit stop 23 projecting from the pouring part 5 of the fixed piece 2—a position in which the rib 38 is not in contact with the ramp 25 and where no area of one or other of the openings 32, 32' in the movable piece 3 is in coincidence with an area of the opening 20 in the fixed piece 2—and the second wall 27 of the ramp 25—a position in which the rib 38 is in contact with the ramp 25 and where the lateral openings 20, 32, 32' in the two pieces 2, 3 coincide.

The rotational movement of the movable piece 3 with respect to the fixed piece 2, in the extraction position, is limited in the direction R1 by the limit stop 23, and in the direction R2 by the second wall 27 of the ramp 25, via the rib 38.

The displacement from the maximum pushing-in position to the extraction position, with coincidence of the openings 20, 32, 32', is guided by the limit stop 23, the ramp 25 and the walls 26, 27 of said ramp 25.

This displacement has to take place according to the arrows depicted in FIGS. 3 and 10, so that the displacement of the movable piece 3 with respect to the fixed piece 2 from the maximum pushing-in position to the extraction position with coincidence of the openings 20, 32, 32' is guided and facilitated.

The invention claimed is:

1. A device for stoppering a container and drawing off a fluid product contained in said container, comprising:

a fixed piece (2) comprising a part (4) for fixing to the container and a pouring part (5) of general cylindrical shape, continuing said fixing part (4) towards the outside of the container, the pouring part (5) being open at two axial ends and having a lateral fluid output opening (20) and means (22) defining a passage allowing the entry of air into the device during pouring of the fluid;

a movable piece (3) comprising a transverse end wall (28) from which there project in the same direction a tube (29) of general cylindrical shape, open at one free axial end and having at least one lateral fluid output opening (32, 32'), and an external skirt (30) making possible a gripping operation of the movable piece (3) from the outside, the tube (29) being mounted with a tight fit in the pouring part (5) of the fixed piece (2) so that the movable piece (3) is:

movable rotationally in the fixed piece (2);

and movable in axial translation with respect to the fixed piece (2), the fixed piece (2) and the movable piece (3) comprising first means (11, 34, 36, 37) designed for defining a first axial position of the movable piece (3) with respect to the fixed piece (2), referred to as a maximum pushing-in position, in which the lateral openings (20, 32, 32') in the two pieces (2, 3) are offset axially to prevent them from being brought into coincidence, and second means (17, 18, 33) designed for defining a second axial position of the movable piece (3) with respect to the fixed piece (2), referred to as the extraction position, in which the lateral openings (20, 32, 32') in the two pieces (2, 3) can be brought into coincidence by rotation of the movable piece (3);

wherein the movable piece (3) also comprises an internal skirt (31) projecting from the transverse wall (28) in the same direction as the tube (29), between said tube (29) and the external skirt (30), said internal skirt (31) having an axial length such that, when the movable piece (3) is in an extraction position, the free end of the internal skirt (31) is situated facing the pouring part (5) of the fixed piece (2), so that, during pouring of the fluid, the fluid contained in the container cannot escape through the passage and in this way allow the entry of air, but is channeled, in the annular space contained between the tube (29) and the internal skirt (31), towards the fluid output opening (20) in the fixed piece (2).

2. A device according to claim 1, wherein the pouring part (5) comprises a prominence (22) projecting towards the outside, substantially diametrically opposite the fluid outpouring (20), said prominence (22) defining a passage allowing the entry of air into the device (1) when the movable piece (3) is in the extraction position and during pouring of the fluid.

3. A device according to claim 1, wherein the fixed piece (2) comprises:

third means (23, 26) intended to cooperate with complementary means (38) provided on the movable piece (3), so as to limit to a reduced value the amplitude of the rotational movement of the movable piece (3) with respect to the fixed piece (2) in the two directions (R1, R2) when the movable piece (3) is in the maximum pushing-in position, and to permit the axial displacement of said movable piece (3) towards the extraction position;

fourth means (23, 25, 27) intended to cooperate with said complementary means (38) provided on the movable piece (3), so as to allow the movable piece (3) to be kept in the extraction position and to limit, in this position, the amplitude of the rotational movement of the movable piece (3) with respect to the fixed piece (2) between a position where the lateral openings (20, 32, 32') in the two pieces (2, 3) coincide perfectly and a position where no area of the opening (32, 32') in the movable piece (3) is in coincidence with an area of the opening (20) in the fixed piece (2), so that the displacement of the movable piece (3) with respect to the fixed piece (2) from the maximum pushing-in position to the extraction position with coincidence of the openings (20, 32, 32') is guided and facilitated.

4. A device according to claim 1, wherein the internal skirt (31) comprises at least one rib (38, 38') projecting towards the axis of the tube (29), and wherein the fixed piece (2) comprises at least one limit stop (23) projecting towards the outside of the pouring part (5) of the fixed piece (2), the rib (38, 38') being intended to cooperate with the limit stop (23) so as to limit the amplitude of the rotational movement of the movable piece (3) with respect to the fixed piece (2) in a first direction (R1), when the movable piece (3) is in the maximum pushing-in position or in the extraction position.

5. A device according to claim 4, wherein the rib (38) projecting from the internal skirt (31) extends over substantially the entire axial height of said internal skirt (31).

6. A device according to claim 4, wherein the tube (29) comprises two diametrically opposite fluid output openings (32, 32'), and in that the internal skirt (31) comprises at least one rib (38, 38') situated at substantially 90° from each opening (32, 32').

7. A device according to claim 4, wherein the limit stop (23) projecting from the pouring part (5) is situated towards the free end (24) of said pouring part (5), the axial height of said limit stop (23) being small compared to the axial height of the pouring part (5).

8. A device according to claim 4, wherein the limit stop (23) is substantially diametrically opposite the lateral fluid output opening (20).

9. A device according to claim 1, wherein the pouring part (5) comprises a ramp (25) which is substantially flat and orthogonal to the axis of the pouring part (5), projecting towards the outside of the pouring part (5) and extending over part of periphery of the pouring part (5), said ramp (25) being situated towards the free end (24) of said pouring part (5), but at a distance therefrom, and being intended to prevent the movable piece (3) from being displaced from an extraction position towards said maximum pushing-in position.

10. A device according to claim 4, wherein the distance between the free end (24) of the pouring part (5) and ramp (25) is substantially equal to the axial height of the limit stop (23) projecting from the pouring part (5).

11. A device according to claim 4, wherein a first end of the ramp (25) is situated in proximity to, but at a distance from, the limit stop (23) projecting from the pouring part (5), in a second direction (R2) opposite to the first direction (R1), so as to limit the amplitude of the rotational movement of the movable piece (3) with respect to the fixed piece (2) in said second direction (R2), when the movable piece (3) is in the maximum pushing-in position.

12. A device according to claim 11, wherein the ramp (25) extends from said first end in the second direction (R2) to a second end, said second of the ramp (25) being continued by a wall (27) substantially parallel to the axis of the pouring part (5) and directed towards the free end (24) of the pouring part (5), said wall (27) being intended to cooperate with rib (38) of the movable piece (3) so as to limit the amplitude of the rotational movement of the movable piece (3) with respect to the fixed piece (2) in the second direction (R2), when the movable piece (3) is in the extraction position.

13. A device according to claim 9, wherein the ramp (25) extends over substantially 90° of angle.

14. A device according to claim 4, wherein, when the movable piece (3) is in the maximum pushing-in position, the rib (38) is placed between the limit stop (23) projecting from the pouring (5) of the fixed piece (2) and the first end of the ramp (25).

15. A device according to claim 4, wherein when the movable piece (3) is in the extraction position, the rib (38) is situated between the limit stop (23) projecting from the pouring part (5) of the fixed piece (2), a position in which the rib (38) is not in contact with the ramp (25) and where no area of the opening (32, 32') in the movable piece (3) is in coincidence with an area of the opening (20) in the fixed piece (2), and the wall (27) continuing the second end of the ramp (25), a further position in which the rib (38) is in contact with the (25) and where the lateral openings (20, 32, 32') in the two pieces (2, 3) coincide.

16. A device according to claim 1, wherein the fixed piece (2) comprises at least one internal flange (17) defining a groove (18) in which a flange (33) projecting towards the outside of the tube (29) of a movable piece (3) is able to be engaged, so as to keep the movable piece (3) axially in its extraction position corresponding to the second position.

17. A device according to claim 16, wherein the internal flange (17) extends over two diametrically opposite arcs each extending over approximately 90°.

18. A device according to claim 1, wherein the first means comprise a tamper-resistant band (34) which connects the external skirt (30) to the fixed piece (2), while not torn off, and keeps the movable piece (3) in the axial maximum pushing-in position, corresponding said first axial position, and in a defined angular position, and that, after tearing off of said tamper-resistant band (34) and translational movement of the movable piece (3) with respect to the fixed piece (2) towards said second axial position, the second means permit a rotation of the movable (3) with respect to the fixed piece (2) in order to bring the lateral openings (20, 32, 32') in the two pieces (2, 3) selectively into coincidence with a view to the dispensing of the product.

19. A dispenser according to claim 1, wherein the fixed piece (2) is fixed by screws to the neck of the container, and wherein the fixed piece (2) comprises, on said fixing part (4), a tamper-resistant ring (13) cooperating by latching with the neck.

* * * * *